United States Patent [19]

Michael

[11] 4,333,487

[45] Jun. 8, 1982

[54] PNEUMATICALLY DRIVEN DRAINAGE FACILITY

[76] Inventor: Harald Michael, Am Gosslers Park 9, 2000 Hamburg 55, Fed. Rep. of Germany

[21] Appl. No.: 127,913

[22] Filed: Mar. 6, 1980

[30] Foreign Application Priority Data

Mar. 6, 1979 [DE] Fed. Rep. of Germany ..... 2908745

[51] Int. Cl.[3] ..... C02C 1/00

[52] U.S. Cl. ..... 137/2; 137/236 R; 137/565; 137/205; 210/170; 4/431

[58] Field of Search ..... 137/236, 565, 205, 2, 137/8; 210/101, 105, 170, 137; 4/431

[56] References Cited

U.S. PATENT DOCUMENTS

| | | | |
|---|---|---|---|
| 377,681 | 2/1888 | Marquand | 137/565 X |
| 3,239,849 | 3/1966 | Liljendahl | 4/431 |
| 3,730,884 | 5/1973 | Burns et al. | 137/236 R X |
| 3,853,138 | 12/1974 | Amren | 137/205 |
| 4,120,312 | 10/1978 | Michael | 137/236 R |
| 4,155,851 | 5/1979 | Michael | 137/236 R X |
| 4,179,371 | 12/1979 | Foreman et al. | 137/236 R |
| 4,245,664 | 1/1981 | Johnson | 137/236 R |

*Primary Examiner*—William R. Cline
*Attorney, Agent, or Firm*—Larson and Taylor

[57] ABSTRACT

For a pneumatically driven drainage facility, an intermediate station for receiving and boosting the liquid and air through the system. This intermediate station comprises a tank with an inlet for receiving the air driven liquid such that the liquid collects at the bottom of the tank. A first branch line communicating with the tank above the surface of the collected liquid extends outwardly from the tank for the passage therethrough of air which has entered the tank. A second branch line leads from the tank for delivering the collected liquid, a pump being provided for passing the liquid from the tank into the second branch line. The two branch lines join again at a point downstream from the tank in a descending conduit section, the first branch line entering the descending conduit section downstream from the entry therein of the second branch line. The descending conduit section ends with a U-shaped adjoining pocket.

11 Claims, 1 Drawing Figure

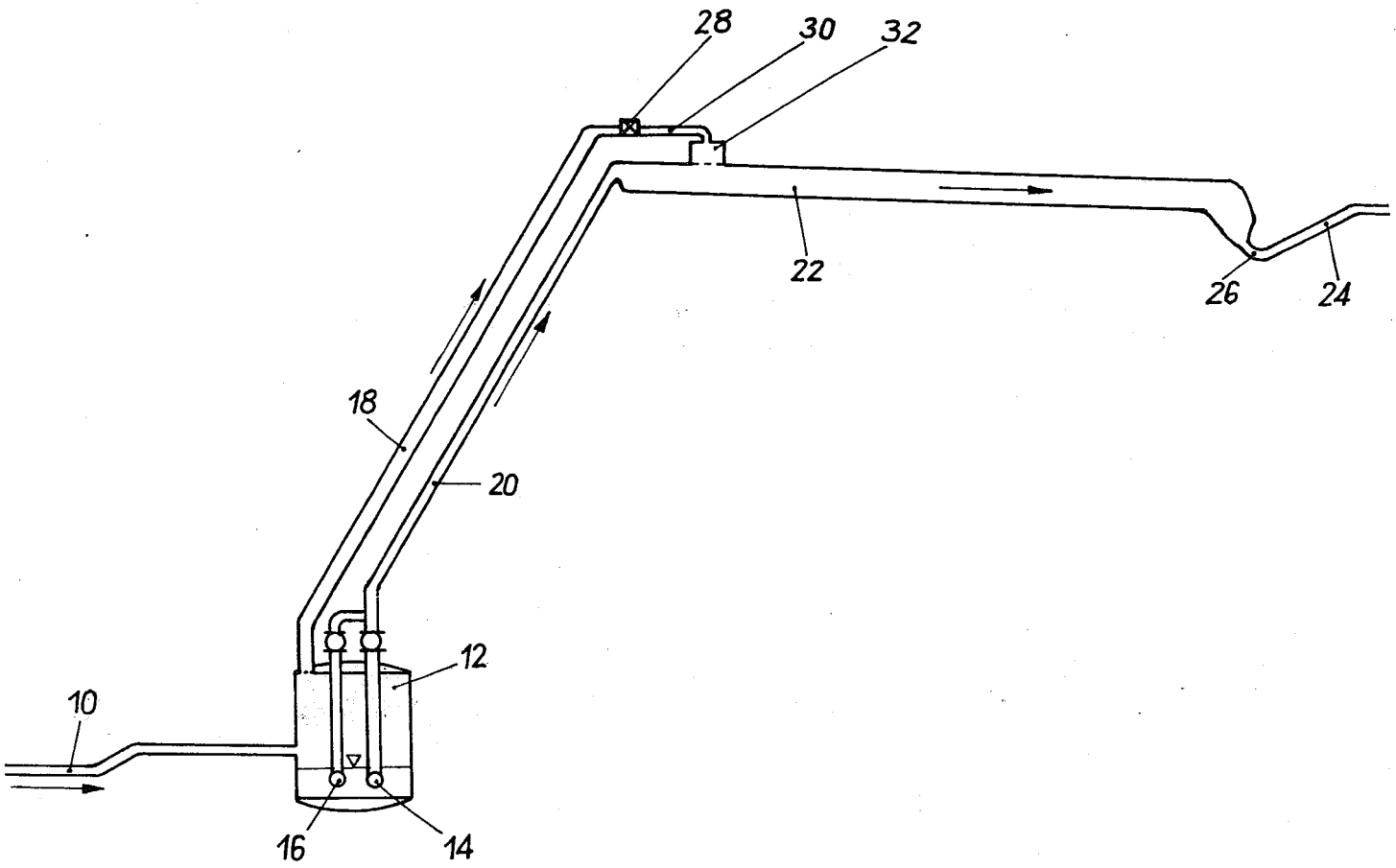
24
26
32
30
28
22
20
18
12
14
16
10

PNEUMATICALLY DRIVEN DRAINAGE FACILITY

The present invention relates to a pneumatically driven, e.g. vacuum driven drainage facility, particularly for large distances of travel and/or great differences in height, whereby the total distance of travel is subdivided into a plurality of sections, each with a separate drive, the sections being connected to one another.

Vacuum drainage facilities are used in local sewage systems for carrying off waste water from connected buildings, and also for suctioning off the waste water in vacation housing communities, in camp sites, in ships and factories. As opposed to gravity drainage conduits, vacuum drainage facilities have the advantages of being operable notwithstanding considerable differences in the level of the terrain, of requiring smaller conduit cross sections, of moving the waste liquid more rapidly, and of being more secure against leakage. Moreover there are compressed air drainage facilities which correspond in many respects with vacuum drainage facilities and which also can be utilized in the field of the present invention.

Vacuum facilities are advantageously operated in such a way that the waste water at the connection points is admitted in relatively small amounts of 8 to 40 liters for example, in order to allow in a specific quantity of air, advantageously about two to fifteen times the volume of the liquid. As a result of the pressure difference between the downstream and upstream sides of the bodies of water which form in the vacuum line, this air drives the water along the conduit.

It is known that in long vacuum lines in a drainage facility which functions with rather large intake quantities of about 400 liters, that intermediate vacuum stations can be used (see U.S. Pat. No. 3,730,884). Therein the waste water is transferred from the collector of a vacuum station into a pressure stage, and from there it is forwarded on the one hand by compressed air and on the other hand by vacuum to the next vacuum station. In this system, a plurality of vacuum stations are needed, as well as waste water pumps to pump the waste water from the collector of an intermediate vacuum station into the pressure stage.

In vacuum lines that overcome height differences which are greater than heights which correspond to the suction power of the vacuum facility, there is an additional difficulty. It is possible to overcome rises of for example 6 to 50 meters of height difference, with an intermediate vacuum station with a pressure stage after each 2 to 4 meters of height difference, or with a single vacuum station wherein the conduit is designed essentially in stages with respect to specific measurements and relationships (see West German publication No. 26 37 765). However the first case is very expensive, and the second case fails if a rising line becomes filled with liquid above a specific amount, because then putting the facility back into operation would no longer be possible without a complicated backward release of the waste water.

The present invention therefore concerns the problem of creating a pneumatically driven drainage facility of the type described which, by relatively simple means, achieves an acceptable forward travel of the waste water over large upgrades or long distances.

This problem is solved according to the present invention in that in the path of a direct pneumatic conduit there is disposed an intermediate tank with a pair of branch lines, whereby a first branch line goes out from the intermediate tank above the surface of the liquid, while waste water flows via a second branch line, from the intermediate tank, by means of a waste water pump, and in that the two branch lines join again at a point downstream from the intermediate tank at the start of a descending section of the conduit which is formed with an adjoining pocket, with the first branch line opening into the conduit above the level of the liquid therein.

With the arrangement of the present invention, differences of height of for example 2 to 50 meters can be overcome without the danger that a rather long water column may have formed in the ascending line which could not be suctioned off. The new facility can also be used if the liquid must flow extraordinarily long distances of e.g. more than 4 to 6 kilometers. In such a case the present invention ensures for example that even at the end of a vacuum line there will still be an adequate vacuum for proper operation.

The simplicity of the proposal according to the present invention results from the fact that in principle the vacuum driving force is done via the first branch line, e.g. with a direct vacuum line, wherein a water bypass (the second branch line) is provided parallel to the first branch line, by means of which a waste water pump pumps the waste water while the air follows the path through the first branch line and can then be further utilized to thrust out the waste water in the vacuum line ahead of it. With uniform balancing of the vacuum drainage facility, therefore, in relation to the delivered quantity of water, there is no need for any increase in the amount of air delivered. This has a positive effect on operational costs. This advantage follows, as noted above, from the fact that the conduit path is not divided into a plurality of mutually independent sections which border on each other with different pressure levels and make necessary a special transfer. Instead, the delivery of the waste water pumps occurs via a bypass integrated into the pressure system of the vacuum line.

Obviously, the amount of air which moves a specific body of water into the intermediate tank and then leaves via the first branch line reaches the descending section before the water which is moved through the second branch line by means of the waste water pump. The air overtakes the water at this point. There is no harm in this however under uniform operating conditions because the air volume in question is used again at the end of the descending section to push out the body of water formed in the adjoining pocket. Correspondingly, the water volume previously thrust by this air into the intermediate tank is later carried along by the air at the end of the descending section.

The descending section has the effect that waste water moved by the waste water pump in relatively large portions from the intermediate tank can be again divided into smaller portions in a simple manner. The descending portion has a relatively large cross section, the diameter of which may range, for example, between 125 and 400 mm so that the waste water in this portion of the conduit, with a drop of e.g. 5 to 8 distance units vertically per 1000 horizontal distance units (referred to hereinafter as "per thousand"), flows freely without filling up the whole conduit cross section in the forward and middle parts of the descending section. The air entrained via the first branch line can thus partly overtake the water running in the descending section and send it in individual smaller bodies through the adjoining pocket in the vacuum line.

For a better understanding of the invention, an explanation is presented below with reference to an accompanying drawing of a preferred embodiment.

The illustrated embodiment is based on the assumption that a group of houses is connected to the end of a vacuum conduit system disposed e.g. between 5 and 50 meters lower than the rest of the conduit system. The waste water from these houses reaches an intermediate tank 12 via a lower vacuum line 10. This intermediate tank 12 has the customary arrangement including at least one pump. Advantageously for reasons of security two waste water pumps 14 and 16 respectively, may be connected in parallel. A first branch line 18 is connected to intermediate tank 12 at the top thereof, through which line only the air flowing in from the lower vacuum line 10 is carried out. Waste water pumps 14 and 16 are so controlled that they pump the waste water collecting on the floor of intermediate tank 12, received from lower vacuum line 10, through a second branch line 20 as soon as a certain level of liquid is reached in tank 12. The rest of the space in tank 12 above said level is therefore available as a vacuum reservoir for lower vacuum line 10. Consequently, line 10 should of course open into intermediate tank 12 above the surface of the liquid.

The two branch lines 18 and 20 join again at a higher level, at the start of a descending section 22 of an upper vacuum line 24. Advantageously, descending section 22 has a very large cross section in comparison to the otherwise conventional cross section of vacuum lines. The inner diameter can be for example about 125 to 400 mm. A drop of about 5 to 8 per thousand is provided, in order that the waste water from the second branch line 20 may flow down with as little resistance as possible. Moreover, the descending section 22 should be of sufficient length so that while the waste water runs down section 22 it can divide, and at the end of the descending section 22 it can be split up by the air in section 22 into individual smaller body portions. For this purpose the two waste water pumps 14 and 16 would advantageously pump between 500 and 1000 liters into the descending section 22 with each pumping cycle, the said section 22 being of such dimensions that its capacity will not be filled by more than 10 to 25% of waste water. In this way it is also ensured that at the same time the waste water quantity delivered into descending section 22 will not produce any pressure in the upper vacuum line 24 and will not therefore develop any water hammer, since each pressure wave would be amplified by the vacuum reservoir in the house connection lines and could lead to damage of the check valves at the house connections of upper vacuum line 24.

In order to provide a portioned division of waste water and air at the end of descending section 22, it is recommended to provide a U-shaped pocket 26 with the smaller cross section of upper vacuum line 24 connected to the downstream end of the descending section 22 via a reduction piece.

If the quantity of waste water fluctuates, then as the water moved by pumps 14 and 16 runs together at the lower end of descending section 22 there can be too little air there to arrive in the desired proportion in pocket 26, of alternatingly relatively small portions of water and air. To alleviate this, an aerating device (not shown) can be placed at the upper end of descending section 22, at the first branch line 18 or on intermediate tank 12. This aerating device can be so controlled as a function of the pressure and/or water level in descending section 22 that in all circumstances with the suctioning off of the waste water from descending section 22 there will be sufficient air available.

Because of the vacuum reservoir in the upper part of intermediate tank 12 and in the lower vacuum line 10, if the design of the connections of branch lines 18 and 20 to descending section 22 is unsuitable, there is danger that waste water from section 22 will be suctioned back again into the first branch line 18. In order to prevent this, branch line 18 can have a check valve 28 at its upper end. In addition, the upper conduit 30 of branch line 18 is advantageously reduced to a diameter of 30 to 60 mm, to make backflow therethrough difficult. The same purpose is served by the connection of this line to descending section 22 via an inverted cup-like widening 32 which has the effect that the opening of branch line 18, 30 will always be above the surface of the liquid in the descending section 22. Finally, the introduction of the branch line 20 from above into the upper end of descending section 22 has a similar effect because in this way a faster and smoother outflow from line 20 into section 22 is obtained. The opening of the first branch line 18 into descending section 22, in the direction of flow, is downstream from the opening of the second branch line 20. These means assure that there is a constant vacuum supply to intermediate tank 12. For the same purpose the ascending part of branch line 18 has a relatively large cross section. At the same time this arrangement prevents trapping therein of water which has penetrated into it, and it facilitates the flow of air through intermediate tank 12 while water falls down into the tank. In a practical arrangement, branch line 18 may for example have an internal diameter of about 80 to 120 mm.

Differing from the above described embodiment, the descending section 22 may be replaced by a receptacle of suitable configuration, where the branch lines 18 and 20 open above and where guide baffles or the like cause a division of the inflowing waste water.

The above-described branching of a pneumatic conduit for waste water in parallel ascending branch lines whereof one is so arranged that it allows air to pass while the other serves for moving the waste water by means of a pump can be utilized not only with vacuum driven facilities but quite generally with pneumatic facilities for waste water or other liquids whether or not the pressure difference needed for the moving of the liquid is produced with reference to atmospheric, excess or vacuum pressure.

Although the invention has been described in considerable detail with respect to preferred embodiments thereof, it will be apparent that the invention is capable of numerous modifications and variations apparent to those skilled in the art without departing from the spirit and scope of the invention.

I claim:

1. A pneumatically driven drainage facility of the type wherein air and liquid travel through a common conduit in the form of alternating bodies of air and liquid, wherein the pneumatically driven air bodies drive the liquid bodies along the conduit, especially for long distances and/or large differences in height, and wherein the total distance of the facility is subdivided into a plurality of connected sections which are connected together at intermediate stations, at least some of said intermediate stations comprising a tank, said tank having inlet means for receiving waste liquid from a conduit and collection means for collecting the received liquid, a first branch line communicating with the tank above the surface level of the collected liquid for the passage through said first branch line of gas received in the tank at said tank inlet means, a second branch line for delivery of the collected liquid out of the tank, and including pump means for pumping said collected liquid into and through said second branch line, said first and second branch lines communicating with a descending conduit section located downstream from said tank, with the first branch line communicating with the descending conduit section above the level of the liquid therein.

2. An intermediate station for use in a pneumatically driven drainage facility of the type wherein air and liquid travel through a common conduit in the form of alternating bodies of air and liquid, wherein the pneumatically driven air bodies drive the liquid bodies along the conduit, comprising a tank, said tank having inlet means for receiving waste liquid from a conduit and collection means for collecting the received liquid, a first branch line communicating with the tank above the surface level of the collected liquid for the passage through said first branch line of gas received in the tank at said tank inlet means, a second branch line for delivery of the collected liquid out of the tank, and including pump means for pumping said collected liquid into and through said second branch line, said first and second branch lines communicating with a descending conduit section located downstream from said tank, with the first branch line communicating with the descending conduit section above the level of the liquid therein.

3. A pneumatically driven system according to claim 1, including an adjoining U-shaped pocket at the downstream end of the descending conduit section.

4. A intermediate station according to claim 2, including an adjoining U-shaped pocket at the downstream end of said descending conduit section.

5. The invention according to any one of claims 1, 2, 3 or 4, wherein the first branch line opens into the descending conduit section downstream from the point of entry of the second branch line into the descending conduit section.

6. The invention according to any one of claims 1, 2, 3 or 4, wherein the descending conduit section has a larger cross section than the second branch line, and said second branch line terminates at an upper portion of said descending conduit section.

7. The invention according to any one of claims 1, 2, 3 or 4, said pumping means being capable of delivering a volume corresponding to 10 to 25% of the capacity of the said descending conduit section.

8. The invention according to any one of claims 1, 2, 3 or 4, wherein the descending conduit section has an internal diameter of 125 to 400 mm and a gradient of 5 to 8 units of distance downwardly per 1000 units of distance horizontally.

9. The invention according to any one of claims 3 or 4, wherein the said adjoining pocket 26 is connected to the downstream end of the descending conduit section and has a substantially smaller cross section than the latter and in joined to the downstream end of the descending conduit section via a reduced cross section piece.

10. A method of causing fluid flow in a pneumatically driven drainage facility comprising the steps of: subjecting the lines of the facility to a change in pressure to cause fluid movement therethrough, said movement comprising the air and liquid travelling through the conduit in the form of alternating bodies of air and liquid, wherein the pneumatically driven air bodies drive the liquid bodies along the conduit, boosting the flow at at least one intermediate station by receiving air and liquid therein, collecting liquid, passing out the air through a first branch line which communicates with the intermediate station above the level of the collected liquid, pumping the liquid through a second branch line separated from the first branch line, and into a downstream descending conduit section, and delivering the air from the first branch line into the descending conduit section above the liquid therein.

11. A method according to claim 10, including delivering the air from the first branch line into the descending conduit section downstream from the point at which the liquid from the second branch line enters the descending conduit section.

* * * * *